US006244406B1

(12) United States Patent
Kolbe et al.

(10) Patent No.: US 6,244,406 B1
(45) Date of Patent: Jun. 12, 2001

(54) DRIVE CLUTCH FOR A PRESSURE CYLINDER

(75) Inventors: Wilfried Kolbe, Gülzow; Klaus Schirrich, Bielefeld; Manfred Terstegen, Bielefeld; Bodo Steinmeier, Bielefeld, all of (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 09/447,637

(22) Filed: Nov. 23, 1999

(30) Foreign Application Priority Data

Jan. 12, 1998 (EP) ..... 98122821

(51) Int. Cl.[7] ..... B41F 13/008
(52) U.S. Cl. ..... 192/69.82; 192/108
(58) Field of Search ..... 192/69.82, 69.8, 192/69, 66.1, 108

(56) References Cited

U.S. PATENT DOCUMENTS 989,007 * 4/1911 Hanson ..... 192/55.6
4,293,061 * 10/1981 Brown ..... 192/69.4
4,645,373 2/1987 Purdy .
5,230,412 * 7/1993 Dawley et al. ..... 192/69.8
6,015,034 * 1/2000 Ruplin ..... 192/69.8

FOREIGN PATENT DOCUMENTS 0713023 5/1996 (EP) .

* cited by examiner

*Primary Examiner*—Charles A Marmor
*Assistant Examiner*—Saul Rodriquez
(74) *Attorney, Agent, or Firm*—Richard M. Goldberg

(57) ABSTRACT

A drive clutch for connecting a drive shaft (12) with an exchangeable cylinder (10) of a printing machine, such that, at one end of the cylinder (10), a locking part (24) is provided and that, in or on the drive shaft, a spanner (32) is disposed, which has a recess (38), which opens up radially and into which the locking part (24) can be introduced positively, and that the spanner (32) can be retracted axially, in order to pull the cylinder (10) with the help of the locking part (24) against the end of the drive shaft (12).

20 Claims, 2 Drawing Sheets

DRIVE CLUTCH FOR A PRESSURE CYLINDER

BACKGROUND OF THE INVENTION

The invention relates to a drive clutch for connecting a drive shaft with an exchangeable cylinder of a printing machine.

It is frequently necessary to exchange cylindrical, rotatable elements, such as printing cylinders, inking rollers and the like of printing machines. These exchangeable, cylindrical elements are referred to in an abbreviated fashion in this application as "cylinders".

Robots are known, with which the generally relatively heavy cylinders can be lifted out of their bearings in the machine frame after the appropriate cap pieces of the bearing have been opened or removed. If the cylinders are driven over mutually meshing gearwheels, the engagement of the teeth is cancelled automatically when the cylinder is lifted out of its bearings. Recently, however, driving systems are increasingly being used, for which the cylinders and rollers of a printing machine, instead of being driven by gearwheel transmissions synchronously with the help of a single driving motor, are driven by a separate driving motor, which is provided for each cylinder and which is seated directly on a drive shaft connected coaxially with the cylinder in question.

SUMMARY OF THE INVENTION

It is the object of the invention to provide a drive clutch which, on the one hand, permits the cylinder to be driven precisely directly and, on the other, to be exchanged easily.

Pursuant to the invention, this objective is accomplished owing to the fact that a locking part is provided at one end of the cylinder and that, in or on the drive shaft, a spanner is disposed, which has a radially opening recess, into which the locking part can be introduced positively, and that the spanner can be retracted axially, in order to pull the cylinder with the help of the locking part against one end of the drive shaft.

During the operation of the printing machine, the cylinder is tensioned axially with the help of the spanner against the end of the drive shaft, so that a positive or preferably predominantly frictional connection between the drive shaft and the cylinder is created. For exchanging the cylinder, the spanner is moved into a release position, in which the locking part can radially leave the recess of the spanner. Accordingly, the cylinder can be uncoupled from the drive shaft in a very simple manner, in that it is moved, with the help of the robot, radially in the direction, in which the recess of the spanner opens up. By reversing this course of motion, the new cylinder with its locking part can be introduced into the spanner and then, by retracting the spanner, tensioned once again against the end of the drive shaft, so that the driving connection is restored.

The inventive drive clutch is intended, particularly for printing machines, in which, although the cylinder is driven over the drive shaft, which is connected coaxially with the cylinder, the cylinder itself is directly supported in the machine frame. Since the bearings in this case have a relatively large diameter, the drive clutch, which naturally must have a certain minimum diameter, can adjoin the bearing site of the cylinder directly or even mesh somewhat with the end face of the cylinder, so that a very small construction is achieved. Moreover, it proves to be advantageous that the cylinder is stressed by the drive clutch axially with the drive shaft. The clutch therefore behaves in a stiff manner in the axial direction and in the direction of rotation, so that the side register and the longitudinal register can be adjusted precisely. On the other hand, in the radial direction, the clutch can be somewhat elastic. This has the advantage that the axis of rotation of the cylinder is defined precisely by the mounting in the machine frame and a slight eccentricity in the drive shaft, resulting from installation inaccuracies, can be compensated, as also described in the European patent application 98 121 059 of the applicant.

Preferably, the mutual facing ends of the cylinder and of the drive shaft together form a friction clutch which, in a particularly preferred embodiment, is combined with a positively meshing clutch, especially a single tooth clutch. In this case, the single tooth clutch serves to hold the cylinder in a defined angular position in relation to the drive shaft, so that the longitudinal register can be adjusted with the help of an angle sensing device, which is disposed at the drive shaft or directly at the motor. However, the driving torque is transferred mainly by the friction clutch.

Preferably, the spanner is tensioned elastically in the clamped position and can be moved into the release position with the help of an actuating rod extending axially through the hollow drive shaft. When the drive shaft is connected coaxially with the motor shaft or formed in one piece with the latter, the actuating rod can extend through the whole of the motor and optionally also through the angle sensing device. For loosening the clutch, the free end of the actuating rod can then be acted upon by a tappet, which is actuated pneumatically or hydraulically and does not need to participate in the rotation of the drive shaft.

BRIEF DESCRIPTION OF THE DRAWINGS

In the following, an example of the invention is explained in greater detail by means of the drawing, in which.

DETAILED DESCRIPTION

Figure 1:
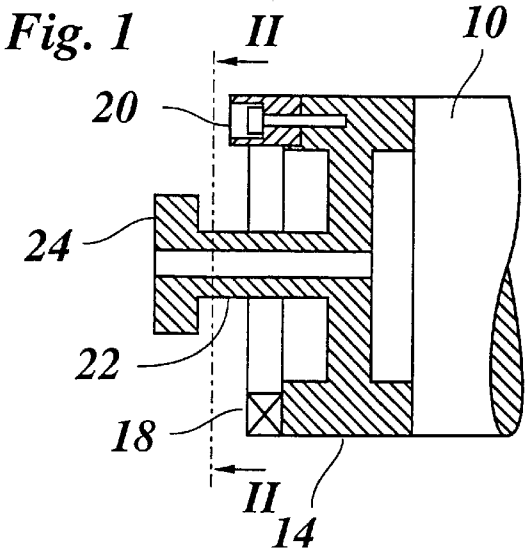
FIG. 1 shows an axial section through the end of a cylinder of a printing machine
Figure 3:
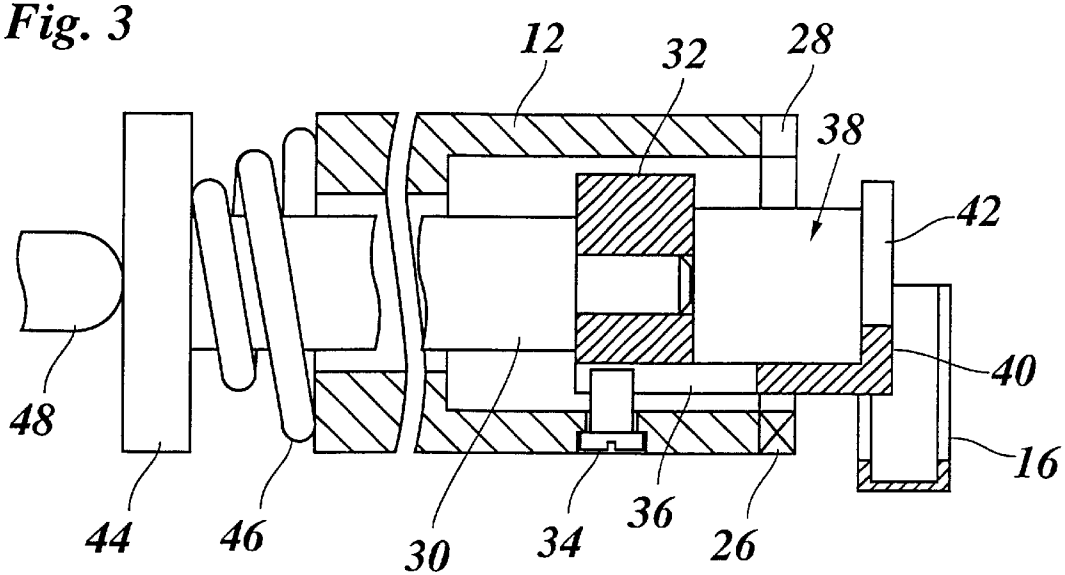
FIG. 3 shows an axial section through a drive clutch.

In FIG. 1, one end of a cylinder 10, for example, a printing cylinder or an inking roller of a printing machine is shown, which is to be connected to a drive shaft 12 with the help of the drive clutch shown in FIG. 3. An end section of the cylinder 10, shown in section in FIG. 1, forms a bearing surface 14 and serves to mount the end of the cylinder 10 in question in a bearing 16 (FIG. 3), which is disposed in a frame of the printing machine that is not shown.

On the front side of the cylinder 10, adjoining the bearing surface 16, a friction ring 18 is disposed, which is interrupted at one place on its periphery by a protruding coupling tooth 20.

Figure 2:
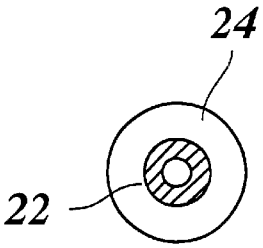
FIG. 2 shows a section in the plane II—II in FIG. 1.

A cylindrical extension 22 protruding coaxially from the end of the cylinder 10 carries at the free end a locking part 24 which, as can be recognized in FIG. 2, is in the shape of a circular disk.

The drive shaft 12, shown in FIG. 3, carries at its end, facing the bearing 16, a friction ring 26 which, when the cylinder 10 is connected, forms a friction clutch together with the friction ring 18 of the cylinder. The friction ring 26 is interrupted at one place on its periphery by a notch 28, which can be engaged by and accurately fits the coupling tooth 20 so that, in the connected state, the angular position of the cylinder 10 is fixed precisely in relation to the angular position of the drive shaft 12.

Figure 4:
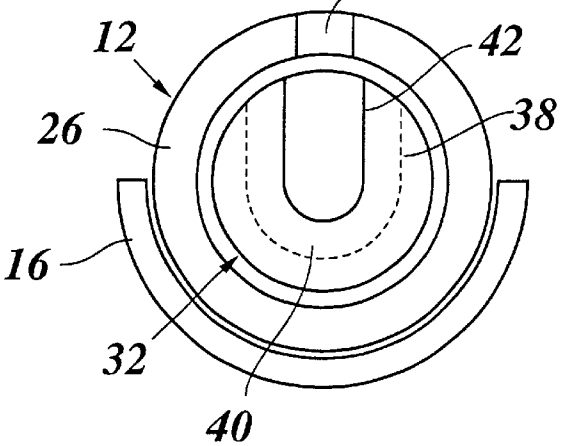
FIG. 4 shows an end view of the drive clutch.

The drive shaft 12 is constructed as a hollow shaft, through which a continuous actuating rod 30 passes axially. At the end of the actuating rod 30, a spanner 32 is fastened, which can be shifted with the help of the actuating rod 30 axially into an end section of the drive shaft 12. The spanner is fixed by a bolt 34, which engages a longitudinal groove 36 of the spanner, so that it cannot rotate in the drive shaft 12. The spanner 32 has a recess 38, which is U-shaped in cross section and opens radially in the direction of the notch 28, that is, towards the top in FIGS. 3 and 4. The recess 38 is bounded at the free end of the spanner by a front wall 40, in which a U-shaped slot 42, which also opens in the upwards direction, is formed.

Figure 5:
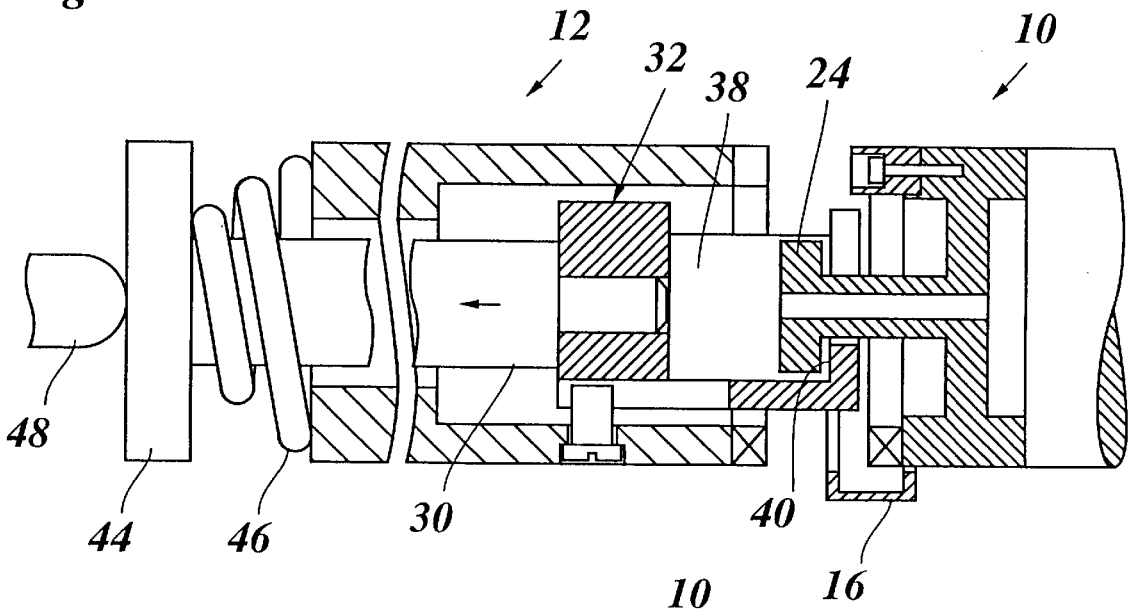
FIG. 5 shows the drive clutch of FIG. 3 during the connection of the cylinder of FIG. 1

At its end, opposite the spanner 32, the actuating rod 30 has a plate 44 and is tensioned towards the left in FIG. 3 by a spring 46, so that it has the tendency to retract the spanner 32 into the interior of the drive shaft 12. In the state shown in FIG. 3, the plate 44 is held by a pneumatically or hydraulically actuated tappet 48 against the force of the spring 46 in a position, in which the spanner 32 protrudes out of the open end of the drive shaft 12. When in this state, the cylinder 10 is placed with the help of a robot, which is not shown, from above into the bearing 16, the locking part 24 enters the recess 38 and the extension 22 is placed in the slot 42 of the front wall 40. This state is shown in FIG. 5.

Figure 6:
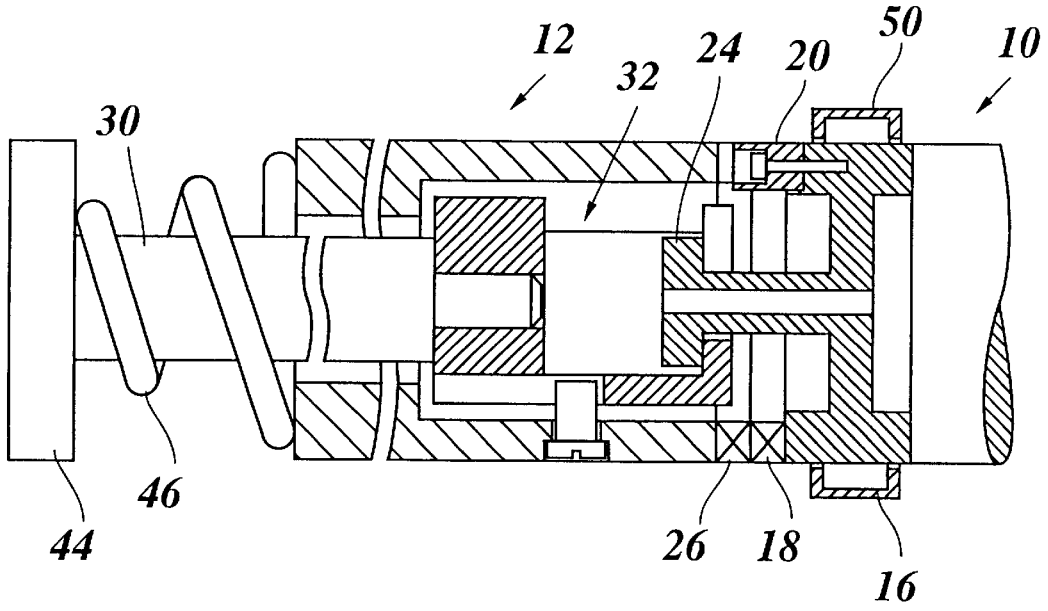
FIG. 6 shows the drive clutch and the end of the cylinder in the connected state.

Subsequently, the tappet 48 is retracted, so that the spring 46 is relieved and shifts the actuating rod 30 and the spanner 32 towards the left. At the same time, the locking part 24 is taken hold of by the front wall 40 of the spanner 32 and the cylinder 10 is pulled axially in the bearing 16 against the end of the drive shaft 12, so that the friction rings 26 and 18 are brought into firm frictional contact with one another, as shown in FIG. 6. At the same time, the coupling tooth 20 enters the corresponding notch 28. In this way, a connection, rigid in the axial direction and in the peripheral direction, is established between the drive shaft 12 and the cylinder 10.

The drive shaft 12, of which only the respective end sections are shown in the drawing, can at the same time form the rotor of a driving motor, which is not shown, so that the drive shaft 12 and also the actuating rod 30 pass axially through the housing of this driving motor. In addition, the drive shaft 12 can also engage a mechanism (not shown) for adjusting the side register, and an angle sensing device for measuring the angular position of the cylinder 10 can be integrated in the motor for adjusting the longitudinal register. All adjustment motions for adjusting the longitudinal register and the side register are transferred by the inventive drive clutch free from backlash to the cylinder 10.

After the cylinder 10 has been coupled to the drive shaft 12 in this manner, the bearing 16 is closed with the help of a bearing cover 50. The axis of rotation of the cylinder 10 is then defined precisely by the bearing 16, which is attached to the frame. If a slight eccentricity develops between the drive shaft 12 and the cylinder 10 as a result of dimensional tolerances during the manufacture or installation of the motor housing, this eccentricity can be compensated for owing to the fact that the friction rings 26 and 18 work radially somewhat against one another. The coupling tooth 20 also engages free from backlash only in the peripheral direction; however, in the radial direction, it engages the associated notch of the drive shaft with backlash. In this way, the transfer of radial forces and/or bending moments to the cylinder 10 is prevented.

When the cylinder 10 is to be exchanged, the bearing cover 50 is opened or removed and the actuating rod 30 is shifted with the help of the tappet 48 once again into the release position. At the same time, the end wall 40 of the spanner 32 can engage the end surface of the cylinder 10 and shift the cylinder into an axial position, in which the locking part 24 lies outside of the drive shaft 12, so that the cylinder 10, with the help of a robot, can be lifted upward out of the bearing 16.

What is claimed is:

1. An assembly in a printing machine, comprising:

an exchangeable cylinder;

a drive shaft; and a drive clutch for connecting the drive shaft with the exchangeable cylinder, said drive clutch including:

a locking part at one end of the cylinder, said locking part including an extension that protrudes from said one end of the cylinder, and a spanner disposed in or on the drive shaft, the spanner having a recess which opens up radially and into which the locking part can be introduced positively, and the spanner being axially retractable, in order to pull the cylinder with the help of the locking part against an end of the drive shaft.

2. The assembly of claim 1, wherein:

the drive shaft is a hollow shaft, and the spanner is guided axially displaceable and non-rotationally in the drive shaft.

3. The assembly of claim 2, further comprising an actuating rod connected with the spanner and which passes through the drive shaft and emerges from the drive shaft at an end opposite to the cylinder.

4. The assembly of claim 1, wherein the spanner is stressed elastically in a retracted position and can be shifted counter to a pre-stressed force into a position, which enables the locking part to be introduced into the spanner.

5. The assembly of claim 3, further comprising a tappet which acts upon the end of the actuating rod emerging from the drive shaft.

6. The assembly of claim 1, wherein mutually pre-stressed ends of the cylinder and the drive shaft form a friction clutch.

7. The assembly of claim 1, wherein mutually pre-stressed ends of the cylinder and the drive shaft form a single tooth coupling with one another.

8. The assembly of claim 7, wherein the recess of the spanner opens radially in a direction of the single tooth coupling.

9. The assembly of claim 1, wherein the spanner has an end wall which forms a boundary of the recess and is constructed to push the cylinder axially away from the drive shaft, when the spanner is extended.

10. The assembly of claim 1, wherein said one end of the cylinder at which the locking part is formed, forms at an outer periphery thereof a bearing surface, with which the cylinder is mounted in a bearing attached to a frame.

11. The assembly of claim 2, wherein the spanner is stressed elastically in a retracted position and can be shifted counter to a pre-stressed force into a position, which enables the locking part to be introduced into the spanner.

12. The assembly of claim 3, wherein the spanner is stressed elastically in a retracted position and can be shifted counter to a pre-stressed force into a position, which enables the locking part to be introduced into the spanner.

13. The assembly of claim 12, further comprising a tappet which acts upon the end of the actuating rod emerging from the drive shaft.

14. The assembly of claim 2, wherein mutually pre-stressed ends of the cylinder and the drive shaft form a friction clutch.

15. The assembly of claim 3, wherein mutually pre-stressed ends of the cylinder and the drive shaft form a friction clutch.

16. The assembly of claim 4, wherein mutually pre-stressed ends of the cylinder and the drive shaft form a friction clutch.

17. The assembly of claim 5, wherein mutually pre-stressed ends of the cylinder and the drive shaft form a friction clutch.

18. The assembly of claim 2, wherein mutually pre-stressed ends of the cylinder and the drive shaft form a single tooth coupling with one another.

19. The assembly of claim 2, wherein the spanner has an end wall which forms a boundary of the recess and is constructed to push the cylinder axially away from the drive shaft, when the spanner is extended.

20. The assembly of claim 2, wherein said one end of the cylinder at which the locking part is formed, forms at an outer periphery thereof a bearing surface, with which the cylinder is mounted in a bearing attached to a frame.

* * * * *